United States Patent [19]

Schultz

[11] Patent Number: 4,982,933

[45] **Date of Patent: * Jan. 8, 1991**

[54] FENCE CONNECTOR CLIP AND ASSEMBLY

[75] Inventor: David H. Schultz, Grand Haven, Mich.

[73] Assignee: Harbor Towne Fence, Inc., Grand Haven, Mich.

[ * ] Notice: The portion of the term of this patent subsequent to Aug. 28, 2007 has been disclaimed.

[21] Appl. No.: 233,830

[22] Filed: Aug. 19, 1988

Related U.S. Application Data

[63] Continuation-in-part of Ser. No. 149,691, Jan. 28, 1988, Pat. No. 4,951,925.

[51] Int. Cl.[5] ..... E04H 17/14

[52] U.S. Cl. ..... 256/65; 256/22

[58] Field of Search ..... 256/65, 67, 68, 69, 256/22, 21, 26, 59; 403/191, 245, 246, 262, 264, 231; 24/671

[56] References Cited

U.S. PATENT DOCUMENTS

| | | | |
|---|---|---|---|
| 101,825 | 4/1870 | Clinger . | |
| 437,592 | 9/1890 | Goetz . | |
| 444,681 | 1/1891 | Windus . | |
| 716,898 | 12/1902 | Hutchings . | |
| 725,527 | 4/1903 | Whitehurst . | |
| 949,394 | 2/1910 | Daly . | |
| 1,791,680 | 2/1931 | Miller . | |
| 2,037,736 | 4/1936 | Payne et al. . | |
| 2,113,196 | 4/1938 | Jones . | |
| 2,118,467 | 5/1938 | Jones . | |
| 2,944,797 | 7/1960 | Magness | 256/22 X |
| 3,031,217 | 4/1962 | Tinnerman | 403/262 X |
| 3,136,530 | 6/1964 | Case . | |
| 3,195,937 | 7/1965 | Case . | |
| 3,304,683 | 2/1967 | Ferreira . | |
| 3,343,811 | 9/1967 | Kusel et al. | 256/22 |
| 3,471,182 | 1/1968 | Schroer . | |
| 3,499,631 | 3/1970 | Heldenbrand . | |
| 3,752,262 | 8/1973 | Helms . | |
| 3,942,763 | 3/1976 | Helterbrand et al. | 256/65 X |
| 3,946,992 | 3/1976 | Elias | 256/68 |
| 3,993,289 | 11/1976 | Lewis et al. | 256/59 |
| 4,073,478 | 2/1978 | Bermudez . | |
| 4,074,893 | 2/1978 | Coltrin | 256/21 |
| 4,101,226 | 7/1978 | Parisien | 256/65 X |
| 4,599,010 | 7/1986 | Hocking | 403/191 |
| 4,600,179 | 7/1986 | Willetts | 256/67 |
| 4,623,126 | 11/1986 | Petit . | |
| 4,723,760 | 2/1988 | O'Sullivan | 256/65 X |

FOREIGN PATENT DOCUMENTS

| | | |
|---|---|---|
| 3404947 | 8/1985 | Fed. Rep. of Germany . |

*Primary Examiner*—Peter M. Cuomo

*Attorney, Agent, or Firm*—Price, Heneveld, Cooper, DeWitt & Litton

[57] ABSTRACT

A fence adapted for mounting on level or uneven terrain includes generally vertical posts, generally horizontal hollow rails, and connector clips for attaching the rails to the posts. The connector clips are received within the inner cavity of the hollow rails and include an elongated opening which is adapted to receive therethrough a stud attached to the vertical post. About the opening and within the rail is provided a retaining structure which facilitates easy insertion of the stud, at various angles, but securely resists withdrawal thereof. The length of the opening is substantially greater than the width of the stud received therethrough, so that deviations of the post from a true vertical position and/or deviations of the rail from a true horizontal position in the erection of the fence on an uneven terrain may be accommodated.

14 Claims, 3 Drawing Sheets

FENCE CONNECTOR CLIP AND ASSEMBLY

This application is a continuation-in-part of copending application Ser. No. 07/149,691, filed Jan. 28, 1988, now U.S. Pat. No. 4,951,925.

BACKGROUND OF THE INVENTION

This invention relates to fencing, and more particularly to a fence connector clip for connecting fence rails to fence posts.

One common technique for mounting metal fencing is to anchor sockets to the ground, insert posts into the sockets, and place caps on the tops of the posts. Typically, the formation of a fence requires labor intensive assembly as well as the use of multiple tools. Connection of the rails to the posts is tedious and time consuming, as is the interconnection of successive rungs to the rails. Moreover, construction on uneven terrain is often particularly complex, even requiring a customized structure and special skills.

Various scaffolding and wall structures have been proposed heretofore including collars or brackets having a horizontal support surface for supporting a horizontal member. Extending upwardly from the support surface is a locating stud for reception in the horizontal member. Separate set screws are required to lock the collar or bracket in position on the vertical post. The studs may be formed integrally with the collars or brackets, or can be secured by means of welding or the like. For further information concerning the structure and operation of such scaffolding, reference may be made to U.S. Pat. Nos. 2,113,196, 2,118,467 and 3,304,683.

SUMMARY OF THE INVENTION

The aforementioned problems are overcome in the present invention wherein a fence assembly utilizing a unique connector clip facilitates quick and easy interconnection of the rails to the fence post.

The connector clip includes a specially configured frame which is adapted to be matingly received within a cavity of a tubular rail. The frame is configured to form a retainer structure which receives an L-shaped stud projecting from an adjacent fence post. The retainer structure is fabricated about an elongated opening to receive the stud so that not only does it securely hold the rail in its proper position, but also permits easy assembly of the fence despite vertical misalignments of the fence post and/or construction of the fence on uneven terrain.

The novel connector assembly has proven that fencing can be erected in a small fraction of the time previously required, using even unskilled labor. Yet the components are readily mass producible at moderate cost.

These and other objects, advantages and features of the invention will become apparent upon studying the following specification in conjunction with the drawings.

DESCRIPTION OF THE PREFERRED EMBODIMENT

Figure 1:
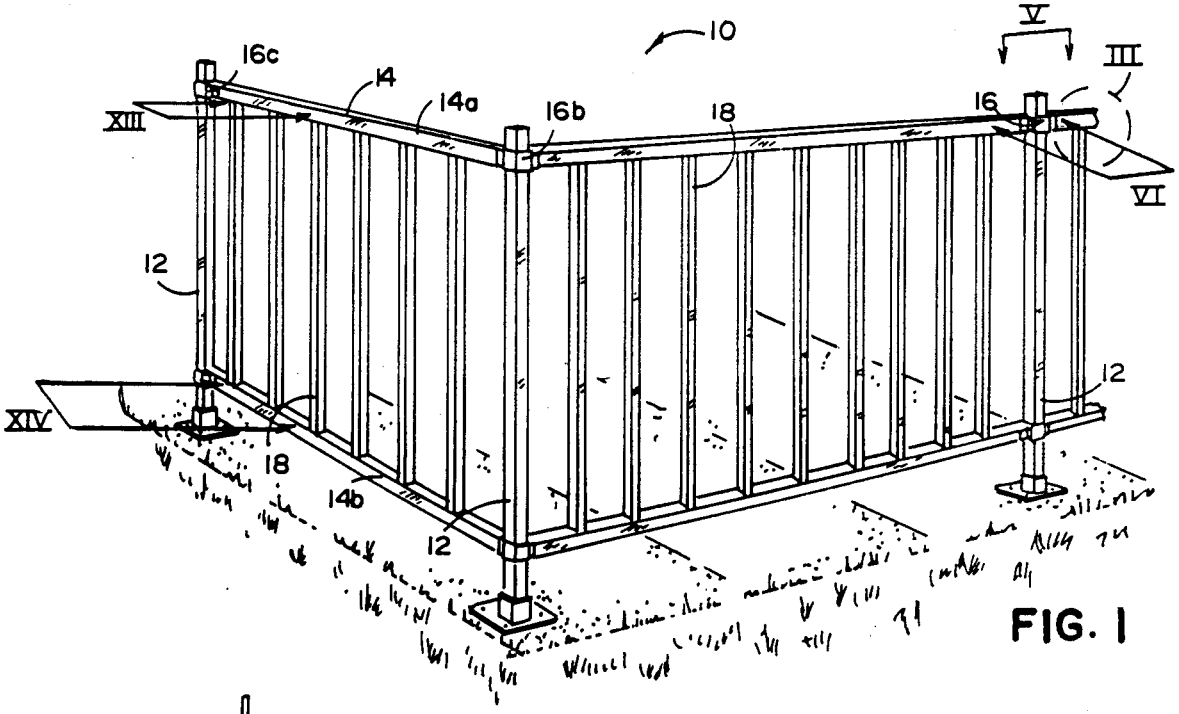
FIG. 1 is a fragmentary, perspective view of a section of fence formed according to this invention.
Figure 2:
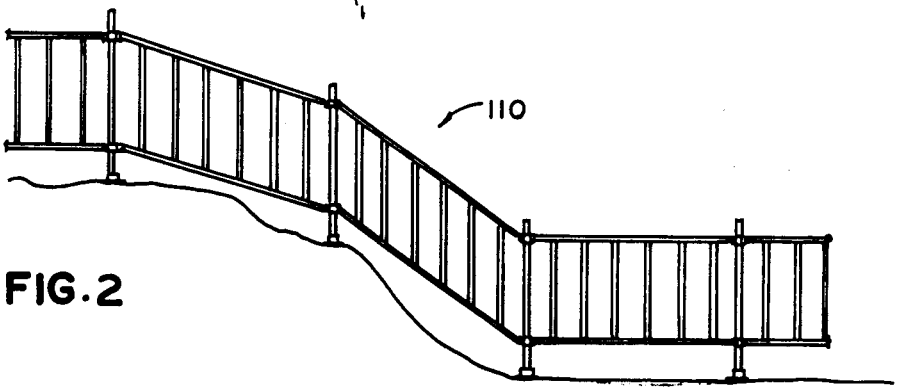
FIG. 2 is a section of the novel fence showing uneven terrain accommodation.

Referring now to the drawings, a fence assembly such as that depicted at 10 in FIG. 1 or 110 in FIG. 2 is readily made by assembly of the components of this invention. These components include a plurality of substantially vertical posts 12, generally horizontal upper and lower rails **14*a* and 14*b*, connector brackets 16 and vertical rungs 18. While a particular configuration is depicted with vertical rungs 18** extending the entire distance between two rails, it is conceivable that a particular fence could employ three or more vertically spaced rails rather than two, could have rung extensions projecting vertically up from the top rail, or other variations for a variety of styles as desired. The novel connector brackets enable variations to be readily made without changing the basic nature of the components except for dimensions.

Vertical posts 12 are shown to be tubular in construction, depicted here as rectangular in cross section. The hollow posts are shown in the preferred embodiment to have a wall which is slightly flexible to be deformable by the stud for secure assembly of the bracket to the post as described hereinafter. Alternate detent facility may be provided in lieu of the slightly deformable wall. The posts may be of tubular galvanized steel construction, preferably having a protective coating thereon. Alternatively, the posts may be of aluminum or the like, as with an anodized surface for weather protection and decorative appeal.

The elongated generally horizontal rails **14*a* and 14*b*** likewise are hollow and depicted here to be of generally rectangular cross sectional configuration. These may be formed of suitable materials such as tubular galvanized steel having a protective coating thereon, or alternatively of aluminum such as one having an anodized decorative surface.

The individual rungs 18 may be of the same material as the posts and/or rails, and may be solid or tubular, of desired cross sectional configuration. These are interconnected with the rails in a manner to be described hereinafter.

Figure 10:
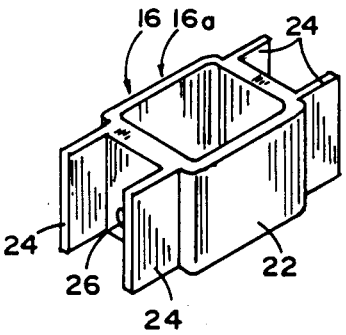
FIG. 10 is a perspective view of one of the connectors having connection flanges on opposite sides of the sleeve.
Figure 11:
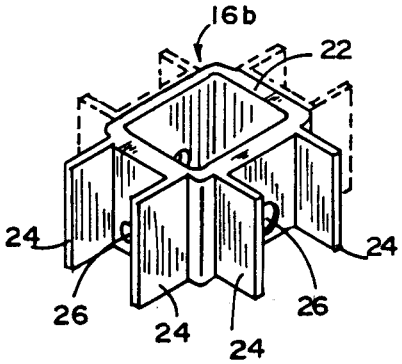
FIG. 11 is a perspective view of a modified connector bracket having the connector flanges on adjacent sides of the sleeve and showing in phantom flanges on the other two sides.

Most of the connector brackets 16 are of the construction depicted in FIG. 10 at 16*a* for coplanar connection of the rails Connector 16*b* in FIG. 11 serves as a corner post connector. Connector 16*c* in FIG. 12 serves as an end post connector. If fencing is to extend in three or four directions from the post, the connector may conceivably be of a type including additional pairs of flanges from the other face or faces (FIG. 11, in phantom).

Referring now specifically to FIG. 10, the connector bracket 16*a* there depicted includes a hollow, vertical, post-receiving sleeve 22, open on its upper and lower ends to slide over a post. It has an internal configuration matching that of the post, here shown to be rectangular with four sidewalls. Extending from two opposite sidewalls of this sleeve are two integral pairs of generally vertically oriented, laterally extending flange members 24. The parallel flange members of each pair are spaced apart sufficiently to receive therebetween the end of a rail 14*a* or 14*b*. These flanges also straddle a threaded orifice 26 through the adjacent wall of sleeve 22.

Figure 12:
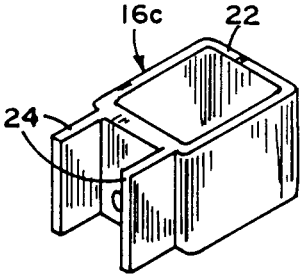
FIG. 12 is a perspective view of an end bracket having connector flanges on only one side of the sleeve.
Figure 3:
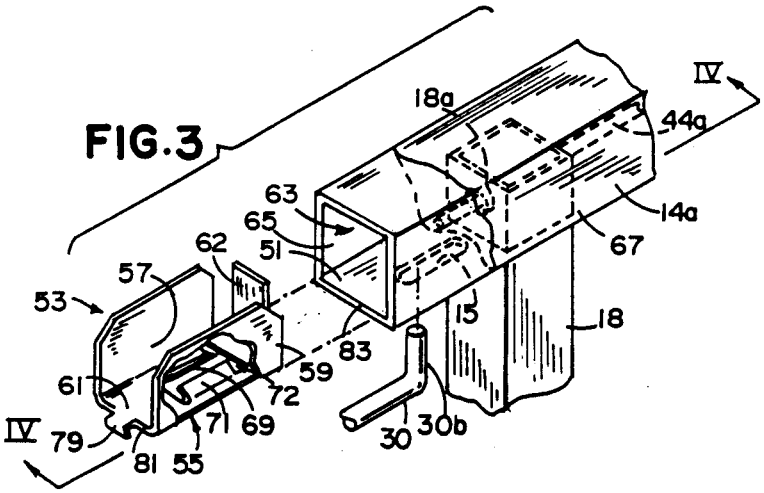
FIG. 3 is an exploded, fragmentary perspective view of the portion encircled by line III in FIG. 1.
Figure 7:
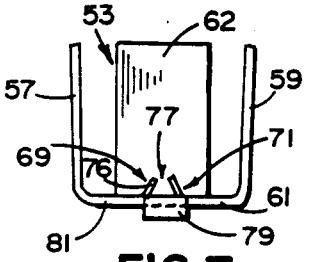
FIG. 7 is a side elevational view of the connector clip of the present invention.
Figure 4:
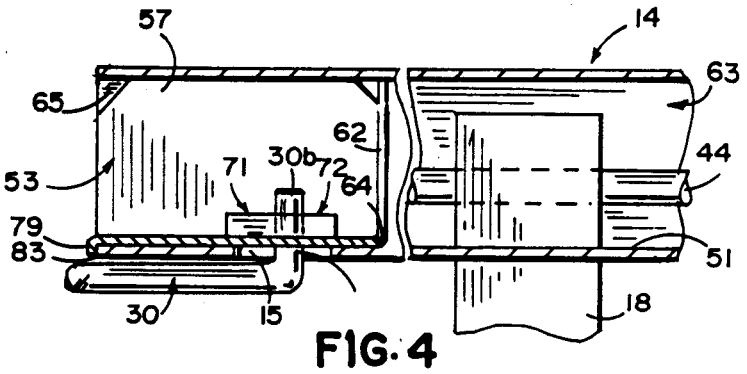
FIG. 4 is a cross-sectional view taken along line IV—IV in FIG. 3.
Figure 8:
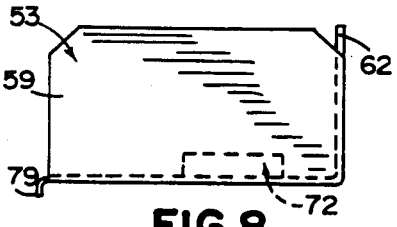
FIG. 8 is a front elevational view thereof.

Corner connector bracket 16*b* depicted in FIG. 11 has integral flanges 24 projecting from adjacent walls of sleeve 22, enabling connected rails to project from each other at an angle less than 180 degrees, here shown to be at 90 degrees. In this bracket also, the flange members straddle threaded orifices 26. To complete the assembly, a certain number of connector brackets in FIG. 12 are made to accommodate end posts. Here sleeve 22 has flange members 24 integrally extending from only one wall of the sleeve.

Figure 6:
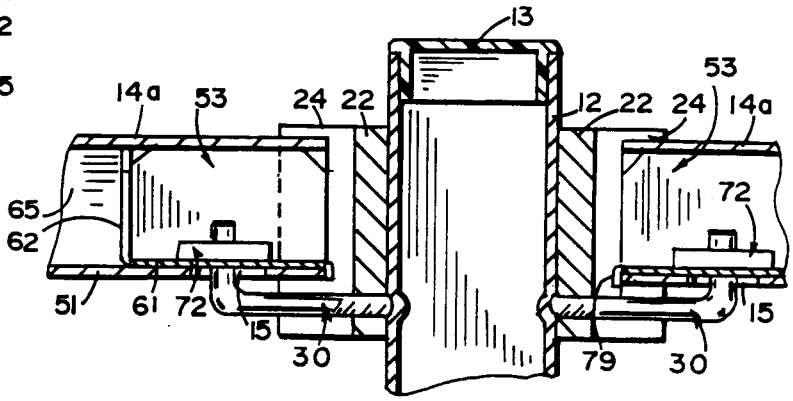
FIG. 6 is a cross-sectional view taken along line VI—VI in FIG. 1.

Cooperative with each threaded aperture 26 is an L-shaped stud 30 having a threaded horizontal leg 30*a* projecting from the post and a vertical leg 30*b* forming a free distal end oriented upwardly when the stud is fully assembled with the threaded aperture (FIG. 6).

An opening 15, in the form of an elongate slot, is provided in the bottom wall 51 proximate the two ends of each rail 14*a*, 14*b*. When the fence is assembled, distal end 30*b* of stud 30 is received through opening 15 and secured in place by a connector clip 53, as will be described below. The length of the opening 15 is substantially greater than the diameter of stud 30, to not only accommodate vertical misalignment of the fence post, but also to permit a vertical pivoting action of the rail to accommodate the assembling of the fence on uneven terrain.

Connector clips 53 can be mass produced from flat spring steel metal web stock, using standard stamping presses and bending brakes to cut and bend the stock into the special form shown. Each connector clip 53 includes a frame 55 having a pair of upstanding legs 57, 59, an interconnecting lower bight portion 61 and an upstanding abutment flange 62 projecting from the inner edge 64 of bight portion 61 to position a locking rod 44*a* or 44*b* as explained hereinafter. Frame 55 is adapted to be matingly received within the cavity 63 of the tubular rails 14, such that bight portion 61 engages the bottom wall 51 and legs 57, 59 engage opposing sidewalls 65, 67. Preferably, legs 57, 59 are positioned at slightly obtuse angles to bight portion 61 so that they are inclined slightly outwardly from a true vertical position. This arrangement, due to the inherent resiliency of the frame 55, frictionally secures the frame 55 in the end of cavity 63.

Bight portion 61 is further configured to include a pair of opposed gripping flanges 69, 71 cooperating to form a retaining structure 72. Gripping flanges 69, 71 are each formed with a first mounting segment 74 oriented in a substantially planar relationship with bight portion 61 and a second free segment 76 which extends upwardly from the horizontal at an angle of approximately 40°, although a wide range of angles could be utilized. Gripping flanges 69, 71 are separated from bight portion 61 by a pair of opposite, transverse end slots 73, 75, and from each other by gap 77. Consequently, slots 73, 75, in conjunction with gap 77, define a substantially I-shaped opening. Slots 73, 75 permit a certain amount of flexing of the gripping flanges 69, 71 to occur when receiving the mounting stud 30, as discussed below.

More specifically, gripping flanges 69, 71 are adapted to straddle and generally overlie opening 15 in rail 14 and receive the distal end 30*b* of stud 30 through gap 77, defined between flanges 69, 71. Gap 77 is dimensioned to have a width smaller than the diameter of stud 30, such that, as stud 30 is pushed upwardly through gap 77, gripping flanges 69, 71 resiliently bend upwardly and outwardly to accommodate the needed clearance while pressing tightly against opposite sides of the stud. Once stud 30 has been positioned between gripping flanges 69, 71, the biasing forces applied by the flanges 69, 71 and the upwardly directed configuration of their free ends 76, prevent stud 30 from being accidentally withdrawn back through opening 15 of rail 14. Hence, rail 14 may be easily mounted to the fence post 12 through the manual interengagement of gripping flanges 69, 71 and stud 30. This construction also permits stud 30 to be gripped adjustably along the length of distal end 30*b* so that the rail 14 may be vertically pivoted to accommodate assembling of the fence as well as final orientation of the fence segments on uneven terrain.

Furthermore, gap 77 is elongated and constructed to have a length which is substantially greater than the diameter of stud 30. This configuration, along with the elongated shape of opening 15 in rail 14, permits stud 30 to be received and retained within connector clip 53 despite vertical misalignments which may occur in the assembling of the fence post 12. The elongated configuration of gap 77 and the adjustable gripping of flanges 69, 71 along stud 30 also facilitates a vertical pivoting of rail 14 to thereby accommodate assembly of the fence on uneven terrain.

In order to ensure that connector clip 53 is properly positioned within cavity 63 of rail 14, a stop 79 is positioned to extend downwardly from the outer edge 81 of bight portion 61. In assembling the fence, then, connector clip 53 is pushed axially into cavity 63 in the orientation as discussed above, until stop 79 abuts the end edge 83 of bottom wall 51 of rail 14.

Figure 13:
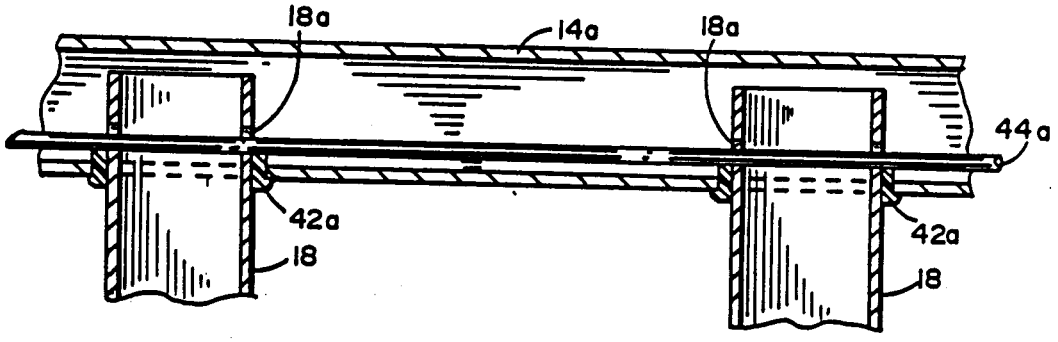
FIG. 13 is an enlarged fragmentary cross-sectional view taken along line XIII—XIII in FIG. 1.
Figure 14:
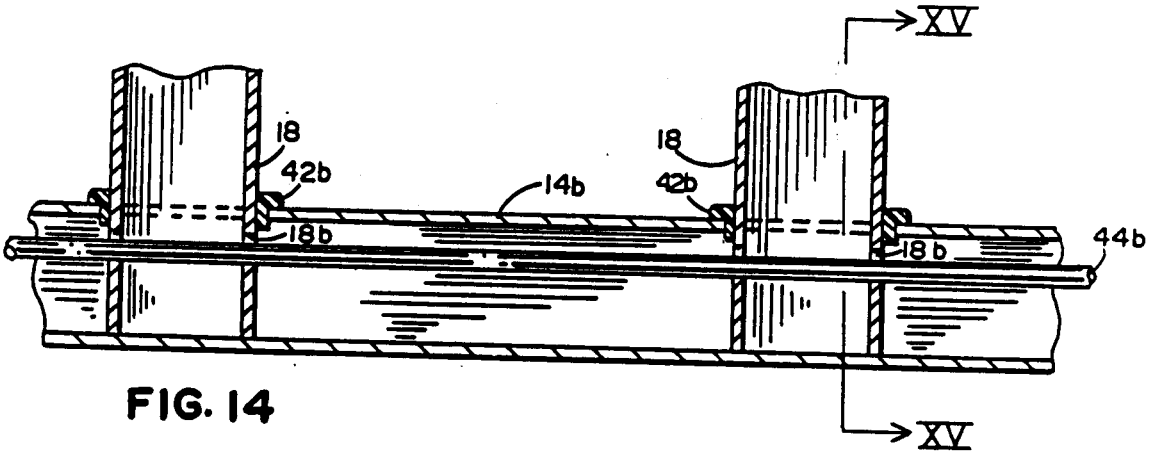
FIG. 14 is an enlarged fragmentary cross-sectional view taken along line XIV—XIV in FIG. 1.
Figure 15:
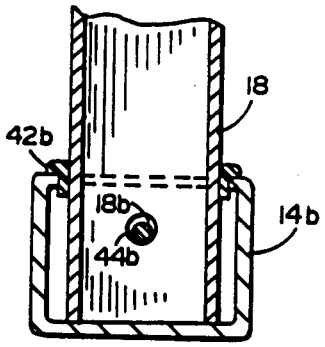
FIG. 15 is a fragmentary cross-sectional view taken along line XV—XV in FIG. 14.

Assembly of rungs 18 to the upper and lower rails 14*a* and 14*b* is preferably as depicted in FIGS. 13 and 14. The bottom wall of upper rail 14*a* has a plurality of spaced openings 40*a* along its length, while lower rail 14*b* has a like plurality of spaced openings 40*b* in its upper wall along its length. These openings preferably have a flexible grommet 42*a* and 42*b* therein, and receive the respective upper and lower ends of rungs 18. The received end portions of rungs 18 have transverse apertures 18*a* and 18*b* therethrough, these apertures being located within the hollow confines of rails 14*a* and 14*b* as depicted. Extending through each rail is a locking rod, i.e. rods 44*a* and 44*b* respectively, which also extend through rung apertures 18a and 18*b* respectively, to secure the assembly together. Apertures 18*a* and 18b are substantially larger in diameter than the diameter of locking rods 44a and 44b to allow easy assembly thereof, to provide a certain amount of parallelogram flexibility to the construction for accommodating uneven terrain, and to provide limited vertical movement, for example, if someone were to stand on the lower rail.

In the assembly of rungs 18 to either of the rails 14a, 14b, one connector clip 53 is inserted within the cavity 63 at one end of rail 14a, 14b prior to the insertion of the locking rod 44a or 44b. The upstanding abutment flange 62 is, then, positioned to function as a stop for locking rod 44a, 44b when it is inserted through apertures 18a, 18b. After the locking rod 44a, 44b is fully inserted (i.e., after it abuts abutment flange 62), a second connector clip 53 is inserted into the other end of the cavity in rail 14a, 14b. By this construction, locking rods 44a, 44b are held in place between abutment flanges 62 despite the assumed orientations of the fence segment during assembly or the positioning of the fence on a steeply inclined terrain.

Figure 5:
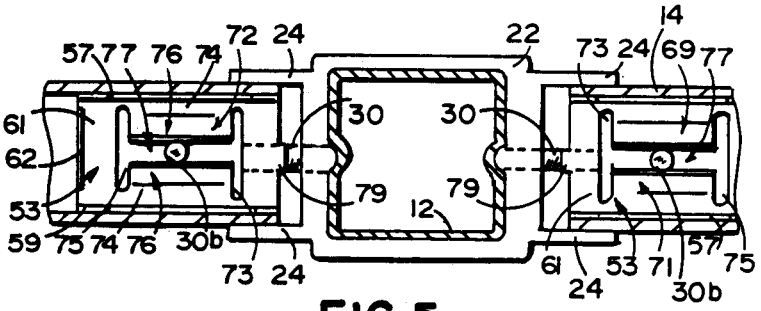
FIG. 5 is a cross-sectional view taken along line V—V in FIG. 1.
Figure 9:
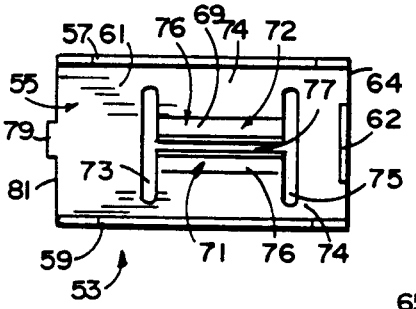
FIG. 9 is a top plan view thereof.

Assembly of the novel construction is rapid and relatively simple. Posts 12 are first mounted as by burial in the ground, anchoring in concrete or bolting to a solid surface, in conventional fashion Connector brackets 16 are then slid down over the post, with L-shaped stud members 30 being threaded through openings 26 into engagement with the deformable walls of the post. Once tightened, these studs are forcefully rotated until the free distal end 30b is in a vertical orientation upwardly, the indentable post wall allowing this final adjustment (FIGS. 5 and 6), with the indentations and the stress thereon lending to a secure attachment.

Rungs 18 are assembled to rails 14, preferably while these elements are simply lying on the ground. The rungs are inserted into the apertures or openings of the rails, and rotationally oriented to enable the locking rods to be inserted endwise through the hollow rails and through the respective transverse apertures of the rungs to connect these components together. Connector clips 53 are frictionally slid into one of the ends of the rails until stops 79 abut edges 83. The locking rods are then inserted into the rails and through the transverse openings 18a, 18buntil they abut the abutment flanges 62 of the inserted connector clips 53. Thereafter, the remaining connector clips 53 are inserted into the opposite ends of the rails 14a, 14b. The rungs and rails are then lifted from the ground as a unit and moved to the posts where the rails are placed vertically down between guiding and protective flanges 24 and mounted on studs 30 received within rail apertures 15 and connector clips 53. These connector clips retain the rails in position, allowing removal only by forceful action. If the terrain is uneven, rails 14 will project at an angle to the substantially vertical posts, but still be generally horizontal (See FIG. 2). The flexible interconnection of the rails to the studs and of the rungs to the rails enables ready accommodation of each section to the terrain.

Each post can have a suitable top cap or plug 13 (FIG. 6) as of plastic or the like friction fit into place to prevent rain entry and provide a finished appearance.

Various additional advantages and features of the invention disclosed in its preferred embodiment will be apparent to those studying this disclosure. It is not intended that the invention is to be limited to the specific preferred embodiment depicted as illustrative, but only by the scope of the appended claims and the reasonable equivalents thereto.

The embodiments of the invention in which an exclusive property or privilege is claimed are defined as follows.

1. A connector assembly for fencing comprising:

a generally vertical post;

a hollow, generally horizontal rail positioned adjacent said post and having at least one wall defining an axial inner cavity, said wall further including a first elongated underside opening extending up therethrough;

a connector clip mounted within said cavity of said rail and including a second elongated opening aligned with said first opening, and a retaining structure positioned about said second opening, said retaining structure including a pair of opposed elongated flanges along opposite sides of said second opening; and a stud attached to said post and said stud including an upwardly projecting free distal end projecting up therefrom, said free distal end being slidably received up through said first and second elongated openings at any point along their lengths and engaged by said opposed elongated flanges of said retaining structure, such that said retaining structure permits easy sliding insertion of said free distal end of said stud into said clip with lowering of said rail down onto said free distal end of said stud, but securely resists withdrawal thereof.

2. The connector assembly of claim 1 in which said first and second openings are elongated in the direction along the length of said rails, such that said openings have greater length dimensions than the width of said stud received therethrough, so that said study can be received through said first and second openings at any position along their lengths and be retained by said retaining structure to thereby accommodate deviations of said post from a true vertical orientation and to accommodate deviations of said rail from a true horizontal orientation in the fencing.

3. The connector assembly of claim 2 in which each of said flanges includes a gripping segment positioned to project at an acute angle away from said wall of said rail.

4. The connector assembly of claim 1 in which each of said flanges includes a gripping segment positioned to project at an acute angle away from said wall of said rail.

5. The connector assembly of claim 1 in which said clip includes a body defined by at least one sidewall, and in which said pair of opposed gripping flanges are separated from said sidewall by a substantially I-shaped opening defined by a pair of transverse slots interconnected by said second opening.

6. The connector assembly of claim 5 in which each said gripping flange further includes a gripping segment positioned to project at an acute angle away from said wall of said rail and a base segment connecting said gripping segment to said sidewall of said clip.

7. The connector assembly of claim 1 in which said rail further includes a pair of opposite ends, and in which said connector clip further includes a stop flange which abuts one end of said rail to effect proper positioning of said clip within said rail.

8. The connector assembly of claim 1 further including:

at least one rung projecting outward from said rail and having an end received within said cavity in said rail, said end of said rung having an aperture oriented longitudinally with respect to said rail;

a locking rod extending along the length of said rail and received through said aperture in said rung to secure said rung end within said cavity of said rail; and an abutment surface on said connector clip to abut an end of said locking rod to thereby properly position and hold said locking rod within said rail.

9. The connector assembly of claim 1 in which said connector clip includes a substantially U-shaped frame having a pair of upstanding legs interconnected by a bight portion, wherein said legs extend from said bight portion at an obtuse angle such that they are resiliently compressed when they are received within said rail to thereby frictionally hold said connector clip therewithin.

10. A connector clip for mounting a generally horizontal hollow rail onto a generally vertical post having a substantially L-shaped study extending therefrom provided with an upwardly extending distal end spaced from the post, said connector clip comprising a substantially U-shaped frame adapted for mating receipt within said rail, said frame including a pair of opposed legs and an interconnecting bight portion, said bight portion having a pair of opposed resilient gripping flanges each having a free end, said free ends defining therebetween a gap for receiving therethrough the distal end of the stud, said gripping flanges further being oriented such that they project away from said bight portion at an acute angle so that said gripping flanges permit easy sliding insertion of the stud therebetween, but securely engage and resist the stud from being withdrawn;

said bight portion further including a pair of transverse edges and a stop flange projecting outwardly in a direction from said bight portion substantially opposite to the extension of said legs therefrom, to abuttingly engage an end of said rail in order to properly position said clip therein.

11. The connector clip of claim 10 in which said gripping flanges further include a base segment attached to and oriented in a planar relationship with said bight portion, and a gripping segment inclined at an acute angle thereto, and in which said bight portion further includes a transverse slot along each end of said gripping flanges, such that said slots in cooperation with said defined gap form a substantially I-shaped opening.

12. The connector clip of claim 10 being further usable to properly position a locking rod extended longitudinally through the rail in attaching at least one generally vertical rung thereto, wherein said bight portion further includes an abutment flange projecting outwardly from the other of said edges in a general direction from said bight portion which is substantially the same as the extension of said legs therefrom, whereby said abutment flange abuts an end of said locking rod to properly position and hold said rod in said rail.

13. The connector clip of claim 10 further usable to properly position a locking rod extended longitudinally through the rail to attach at least one generally vertical rung thereto, wherein said bight portion further includes a pair of transverse edges and an abutment flange projecting outwardly in a direction from said bight portion which is substantially the same as the extension of said legs therefrom, to abuttingly engage an end of said locking rod in order to properly position and hold said rod in said rail.

14. The connector clip of claim 10 in which said legs extend from said bight portion at an obtuse angle such that they are resiliently compressed when they are received within said rail to thereby frictionally hold said connector clip therewithin.

* * * * *

UNITED STATES PATENT AND TRADEMARK OFFICE

CERTIFICATE OF CORRECTION

PATENT NO. : 4,982,933

DATED : January 8, 1991

INVENTOR(S) : David H. Schultz

It is certified that error appears in the above-identified patent and that said Letters Patent is hereby corrected as shown below:

Column 3, line 3;
After "rails" insert -- . --;

Column 5, line 25;
After "fashion" insert -- . --;

Column 6, lines 19 & 20;
After "end" delete -- projecting up therefrom --;

Column 6, line 34;
"study" should be -- stud --;

Column 7, line 20;
"study" should be -- stud --.

Signed and Sealed this

Twenty-third Day of June, 1992

*Attest:*

DOUGLAS B. COMER

*Attesting Officer*

*Acting Commissioner of Patents and Trademarks*